United States Patent [19]

Tornqvist

[11] 4,002,135

[45] Jan. 11, 1977

[54] SHIP FOR COMBINED LOAD

[76] Inventor: Bengt Wilhelm Tornqvist, Hovslagargatan 5 B, Stockholm, Sweden

[22] Filed: Apr. 30, 1975

[21] Appl. No.: 572,894

[30] Foreign Application Priority Data

May 15, 1974 Sweden ..... 7406502

[52] U.S. Cl. ..... 114/72; 114/73; 114/74 R

[51] Int. Cl.[2] ..... B63B 25/00

[58] Field of Search ..... 114/72, 73, 74 R; 214/15 D, 15 E, 15 R

[56] References Cited

UNITED STATES PATENTS

| | | | |
|---|---|---|---|
| 2,853,968 | 9/1958 | McLean | 114/72 |
| 3,162,168 | 12/1964 | Ferris et al. | 114/72 |
| 3,253,746 | 5/1966 | Vreedenburgh | 114/74 R X |
| 3,434,445 | 3/1969 | Crumley | 114/72 |
| 3,572,276 | 3/1971 | Skaarup | 114/73 |

FOREIGN PATENTS OR APPLICATIONS

| | | | |
|---|---|---|---|
| 2,325,912 | 12/1973 | Germany | 114/72 |

*Primary Examiner*—Trygve M. Blix
*Assistant Examiner*—Sherman D. Basinger

[57] ABSTRACT

A ship for the simultaneous storage and transport of a high density flowable bulk cargo and a lower density general cargo. The ship includes a hull, a main deck and a hold below the main deck adapted to store the flowable bulk cargo therein. A plurality of loading decks are arranged fixedly above the main deck and extend over a substantial portion thereof in spaced superposed relation. Conveying devices such as mechanical conveyors or conduits and pumps are mounted beneath the main deck and extend lengthwise of the ship so as to convey the flowable bulk cargo from one end of the ship towards the other end for discharge into selected sections of the hold.

6 Claims, 3 Drawing Figures

PROFIL

PROFIL

SEKTION B

SEKTION A

SHIP FOR COMBINED LOAD

The invention relates to a ship suitable for transporting simultaneously goods with relatively low volumetric weight, preferably motorcars or containers, and goods with relatively high volumetric weight in the form of loose commodities, for instance bulk or liquid cargos.

A tendency towards lighter freights has been noted in maritime business. This involves that the hold capacity of normal ships is fully exploited without taking advantage of approximating the allowed dead weight. This, for instance, is the case with motor vehicles which are extensively transported by ship. The volumetric weight, for instance, of passenger cars in relation to the least space required is of the order 100 kg/m$^3$. To those skilled in the art these figures are illustrative of an uneconomic use of the cargo space in shipping only this type of load.

It appears therefore to be advantageous to combine car freight with bulk freight, the latter having a considerably higher volumetric weight. This load combination, however, gives rise to special problems in connection with the loading and unloading of the ship and the cleaning of the holds after shipping bulk loads so as to be suitable again for car loadings. Apparently the heavier load has to be held below the lighter one. This would not involve any serious problems, if convenient loading and unloading of cars would not require large continuous surfaces. Because of the large continuous deck surface required for car loadings the underlying cargo space is of difficult access when loading and unloading bulk cargo.

A ship construction resolving this problem is known, whereby at least a portion of the total cargo space is partioned by transversal bulkheads into individual cargo compartments, lying behind each other in the longitudinal direction of the ship and arranged for receiving alternatively motor vehicle loads and bulk loads. Such a ship has proved to be a good solution to the above mentioned problems but requires relatively important structural changings in a conventional ship body. This prior arrangement is intended to facilitate the access to the bulk cargo spaces from above through the usual loading hatches via conventional loading and transport means. One disadvantage, however, is that the space available for the bulk cargo is too limited and only suitable for particularly heavy bulk cargos, for instance ore.

The object of the present invention is to obtain a ship suitable both for bulk or liquid cargos and for relatively lighter cargos, such as motor cars, without necessitating too important structural changings in conventional ship bodies. The particular characteristic of the present invention is mainly that the loading decks required for the relatively lighter commodities are arranged above the main decks, approximately along the whole length and beam of the ship and that the ship is arranged to receive the bulk cargo on conveyors or pipe lines positioned under the main deck in the longitudinal direction of the ship and at a certain distance of one of the stems to convey the load towards the opposite stem and deliver the same to holds situated under the conveyors.

This construction allows easy loading and unloading of bulk cargo to and from different holds, which do not need to be accessible each from above. The decks to be used for the relatively lighter load, for instance motor vehicles, can be designed almost exclusively in consideration of the load to be carried, regardless of the loading and unloading conditions of the bulk cargo underneath.

According to the invention the ship suitably is provided with conveyors known per se, positioned at the bottom of the holds to transport the bulk cargo being unloaded towards one of the stems.

As an alternative all of the holds can be provided with lifting conveyors to be used when unloading the bulk cargo. Hereby the bulk cargo is hoisted again onto the loading conveyors which in reversed motion direction function as discharge conveyors. In case of liquid bulk cargo the conveyors are replaced by pumps, valves and pipes and the holds are constructed to suit the liquid load.

Considering that loading and unloading bulk cargo partly require different arrangements, it is suitable to arrange the ship in such a way that for instance the loading is carried out at the stem and the unloading at the stern or vice versa. This involves that all of the conveyors, i.e. as well the loading as the unloading conveyors, are adapted to transport the bulk cargo in the same direction in relation to the ship.

According to one embodiment of the invention the loading conveyors consist of a plurality of conveyors extending along different lengths of the ship and arranged to deliver the bulk cargo at the end opposite the loading place into different holds.

According to another embodiment of the invention the loading conveyors are provided with distributors arranged at determined intervals along the loading conveyors, so as to cyclically deliver the bulk cargo to the different holds.

As mentioned before, the invention makes it possible - without need of too important structural alterations - to provide a conventional ship body with a superstructure (which can be fabricated at least to a certain degree) for the conveyance of, for instance, motor vehicles.

One embodiment of the invention is diagrammatically illustrated with reference to the accompanying drawings, in which.

Figure 1:
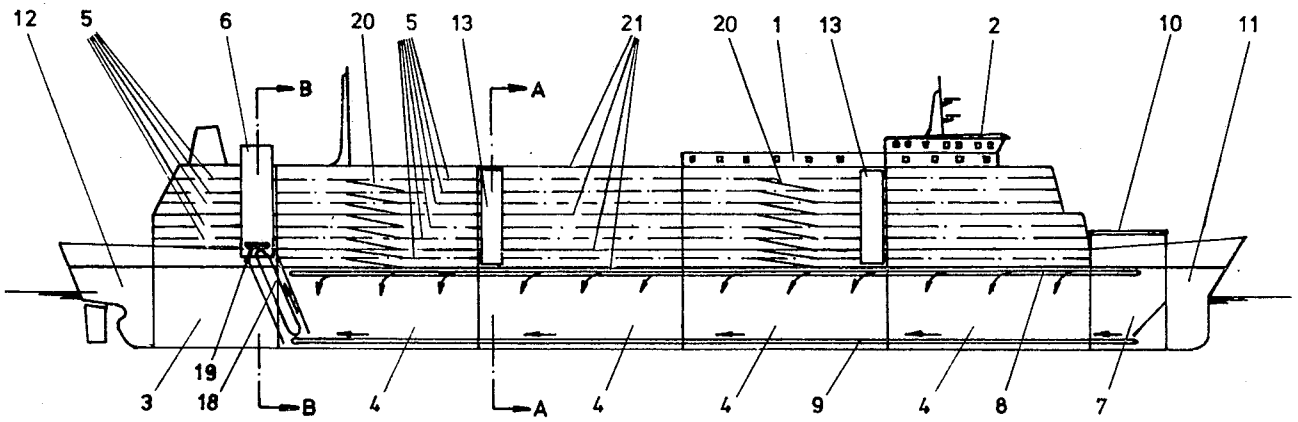
FIG. 1 is a side view of a ship according to the invention.
Figure 3:
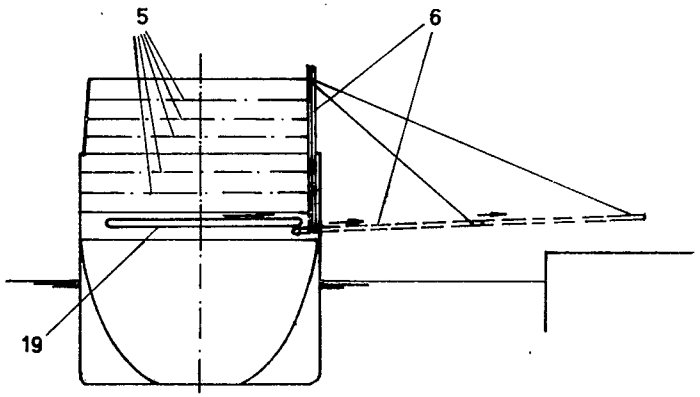
FIG. 3 is a section of FIG. 1 along B—B.
Figure 2:
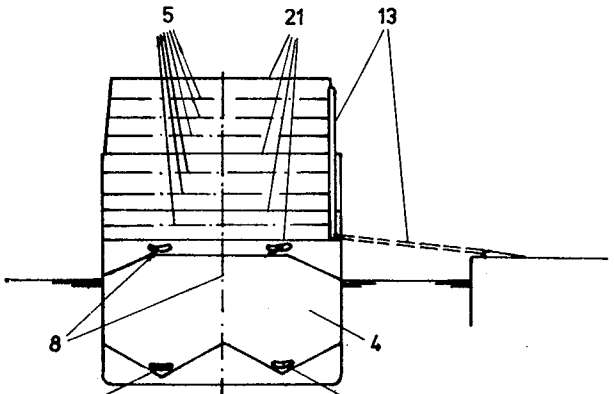
FIG. 2 is a section of FIG. 1 along A—A.

The FIGURES show a ship according to the invention built on a conventional body comprising a section 1 with lodgings, a navigation bridge 2, machine rooms 3 and holds 4 for bulk material. On the body a certain number of car decks 5, 21 are arranged extending substantially along the whole length and beam of the ship. For constructional and resistance reasons certain decks are built as steel decks 21 to stiffen the ship while the remaining decks are of a lighter construction.

The arrangements of the loading decks 5, 21 according to the invention prevents the holds 4 from being accessible in a conventional way from above through usual loading hatches. Therefore, a hold 7 is arranged in the head part of the ship, said hold being accessible by way of a hatch 10. A certain number of conveyors 8 arranged under the deck extend in the head part of the ship so as to be positioned under at least a part of the loading hatch 10. Conventionally, the body is provided with a stem 11 and a stern 12.

The motor vehicles are loaded and unloaded via car loading ramps 13, leading to one or more of the cargo decks 5, 21. On board the vehicles can be transported between the cargo decks by way of the inner ramps 20.

As mentioned above, the bulk cargo is loaded through the loading hatch 10 onto the conveyors 8. These conveyors progressively transport the bulk cargo astern deliver the bulk cargo to holds 4 located under the conveyors 8. The bulk cargo can be delivered to the holds for instance by separate distributors, placed at intervals along the conveyors. As an alternative the conveyors can have different lengths in order to transport the bulk cargo to the particular holds 4.

The bulk cargo is unloaded by means of discharging conveyors 9, situated under the holds 4 and arranged to transport the bulk cargo astern to a certain number of hoisting conveyors 18, lifting the load to transverse conveyors 19 for further transport via the conveyors 6 to a receiving station on land.

The invention thus allows the loading and unloading of bulk cargos without any need of conventional hatches to access to the holds. This in turn involves that the motor car decks above the holds can be designed to the purpose of handling and lashing vehicles regardless of compromises owing to the handling of bulk cargo. This permits optimal use of the ship capacity and allowed dead weight.

Although the invention has been described with reference to one embodiment of the same, it can nevertheless be arbitrarily varied within the scope of the following claims.

What is claimed is:

1. A ship for simultaneously transporting a high density flowable bulk cargo and a lower density general freight comprising a hull having at least one hold to store a flowable bulk cargo therein, general cargo storage means comprising a main deck covering said hold and a plurality of vertically spaced apart loading decks covering said main deck, said loading decks being fixedly mounted on said main deck and extending over a substantial part of the entire length and beam of the ship and preventing access to the hold through that portion of the main deck surmounted by said loading decks, flowable cargo conveying means positioned below said main deck and extending lengthwise of the ship from substantially one to the other end thereof, access means at least one end of the ship beyond the longitudinal ends of the loading decks and above an underlying end portion of said conveying means for supply thereto of said flowable bulk cargo for conveyance thereof from said one to said other end of the ship and for delivery of said cargo during said conveyance to selected sections of the hold, and means forming part of said conveying means for conveying for discharge of said flowable bulk cargo from said hold.

2. A ship according to claim 1, wherein said last-named means are located at the bottom of said hold.

3. A ship according to claim 1, wherein said hold is subdivided in a plurality of compartments, each of said compartments being provided with a lifting conveyor for selectively moving the flowable bulk cargo to or from said compartment.

4. A ship according to claim 1, wherein said hold is subdivided into a plurality of compartments and said conveying means to deliver the flowable bulk cargo into each of said compartments.

5. A ship according to claim 1, wherein said loading decks comprise a prefabricated ship superstructure mounted on a conventional body of a bulk cargo ship.

6. A ship according to claim 1, wherein an inclined ramp is provided between adjacently superposed loadig decks to interconnect same, at least one loading ramp being provided to connect said plurality of loading decks with shore loading areas.

* * * * *